US006098326A

United States Patent [19]

Campbell, III

[11] Patent Number: 6,098,326

[45] Date of Patent: Aug. 8, 2000

[54] LOCATOR SIGN

[75] Inventor: Warren A. Campbell, III, Annapolis, Md.

[73] Assignee: Century 2000, Ltd., Annapolis, Md.

[21] Appl. No.: 09/204,059

[22] Filed: Dec. 3, 1998

[51] Int. Cl.[7] ..... G09F 13/04

[52] U.S. Cl. ..... 40/575; 40/564

[58] Field of Search ..... 40/564, 575, 576, 40/570, 550, 617; 362/812

[56] References Cited

U.S. PATENT DOCUMENTS

| | | | |
|---|---|---|---|
| 1,432,732 | 10/1922 | Stewart et al. . | |
| 1,712,966 | 5/1929 | Marsh | 40/617 X |
| 1,786,033 | 12/1930 | Smith . | |
| 1,857,882 | 5/1932 | Shipman | 40/575 X |
| 1,888,406 | 11/1932 | Payberg | 40/575 |
| 3,840,732 | 10/1974 | Cohen . | |
| 4,553,345 | 11/1985 | Bercier et al. . | |
| 4,901,461 | 2/1990 | Edwards et al. . | |
| 4,903,423 | 2/1990 | Hinca | 40/575 X |
| 4,967,317 | 10/1990 | Plumly | 40/570 X |
| 5,365,411 | 11/1994 | Rycroft et al. | 40/570 X |
| 5,454,181 | 10/1995 | Rothman et al. . | |

*Primary Examiner*—Terry Lee Melius
*Assistant Examiner*—William L. Miller
*Attorney, Agent, or Firm*—Stevens, Davis, Miller & Mosher, LLP

[57] ABSTRACT

A locator sign system for identifying a house, office or other location, mounted in a window, inside the location. The system comprising a light box display housing with a front panel; a sign panel; a sash clip; a hanging cord; and a lighting assembly panel. The light box uses 125 volt AC house current to power low voltage miniature lights, which are mounted by clips on the panel. The lights projecting light beams from the top of the housing, and projecting light through any one of translucent pre-printed sign panels of varying messages for identifying the location at increased distances therefrom. Typically, the illuminated sign system can be operated in ON, OFF or BLINK modes by a three position switch and blinker bulb which can be automated by addition of a 125 volt AC house timer. The system operates for the purpose of attracting attention to the location for deliveries, emergencies, house number, messages, greetings, advertisements, decoration and the like.

21 Claims, 3 Drawing Sheets

911 HELP! 911

LOCATOR SIGN

FIELD OF THE INVENTION

This invention relates to illumination devices, and more particularly to devices for the identification of a house, office or other location for a specific purpose or purposes such as delivery location, emergencies, house number, messages, greetings, advertisements, or decoration and to identify that location from increasing distances.

BACKGROUND OF THE INVENTION

An improved illuminated sign for a low cost, efficient way to expedite locating a specific location for a timely delivery, an emergency, a message, an advertisement, or to display a greeting that can be easily seen from increasing distances is a continuing problem. Exterior house numbers, lamp posts, or other identifiers are easily damaged, denigrated by weather, lost in the shrubbery or otherwise obscured from vision.

The greater the distance of the location from the roadway, the more difficult it is to locate. Modem housing and office developments with many buildings placed close together which all look very similar further delay or detain a timely arrival at the desired location.

Therefore an economical locator sign is needed which can efficiently and effectively locate the desired location very quickly, even if some of the previously mentioned conditions prevail. A system is necessary which is low cost and easy to use and maintain by the average consumer without the need for costly installation, or special technical knowledge; a system which can provide multiple functions and operate in different modes, either for a residential or commercial purpose; a system which can be operated and maintained quickly and easily and without the use of tools, utensils, or skilled service personnel.

SUMMARY OF THE INVENTION

This invention solves the problem of end user economical and efficient location identification with a low cost, easily operated and maintained locator sign with various sign messages for announcing a location, event, or holiday greeting. This locator sign is intended for indoor use, and therefore is not vulnerable to the ravages of sun, wind, rain, vandals, or other exterior elements.

It is designed to hang from a sash by its unique hanging cord and sash clip, or alternatively to sit on a window sill, sash, table or other flat surface near a window. To use the locator sign, simply position it in the window and plug it in to any 125 volt AC outlet.

It is brightly lighted by an internal lighting system that projects attention getting beams above the sign, and directs bright even light through the message sign panel which can be seen and read at increasing distances. To attract additional attention it can be operated in a blink mode as well as a steady on mode. When not in use, it can be turned to the off position and left in place. It is attractive, unobtrusive and blends in as would any other small household appliance.

For instance when using the locator sign to direct a pizza delivery person to the house, simply turn it to "ON" or "BLINK" and drop in the pizza delivery sign panel. It projects a bright message to the delivery person in daylight or darkness and helps get the pizza there hot. If using the locator sign for emergency service personnel, put in the 911 emergency sign panel and place the sign in the "BLINK" mode. It is sure to attract their attention. If used with a holiday greeting decorative sign panel, it can by automated by simply adding an ordinary household timer between the locator sign power plug and the wall outlet. Just set the mode to "ON" or "BLINK", and the timer will turn the sign on and off automatically. The locator sign accommodates any one of several message signs covering deliveries, emergencies, announcements, greetings, advertisements, decoration or identifying house numbers, and the like. Each sign panel just lifts out or drops into place through a slot in the top of the light box with two fingers, and requires no tools nor utensils for operation or service.

DETAILED DESCRIPTION OF THE INVENTION

Figures 1, 1A, 1B, 1C:
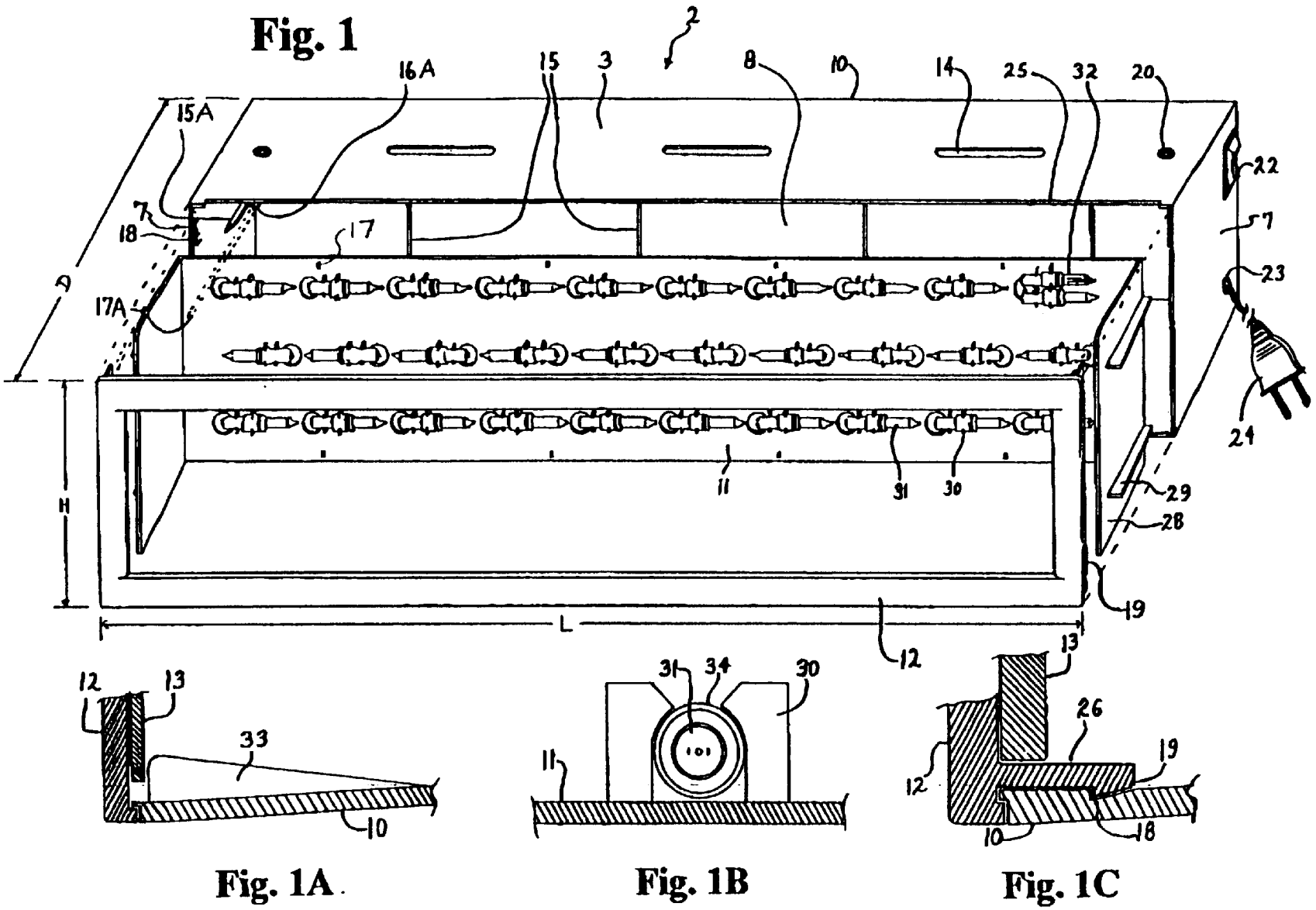
FIG. 1 Illustrates an exploded perspective view of the locator sign of the present invention including a light box, lighting assembly panel, and front panel.
FIG. 1A shows a cross-section of a lower portion of the locator sign of FIG. 1.
FIG. 1B shows a cross-section of a retaining clip for holding a light bulb in the locator sign of FIG. 1.
FIG. 1C shows a cross-section of a clip of the locator sign of FIG. 1.
Figures 2, 2A, 2B, 3:
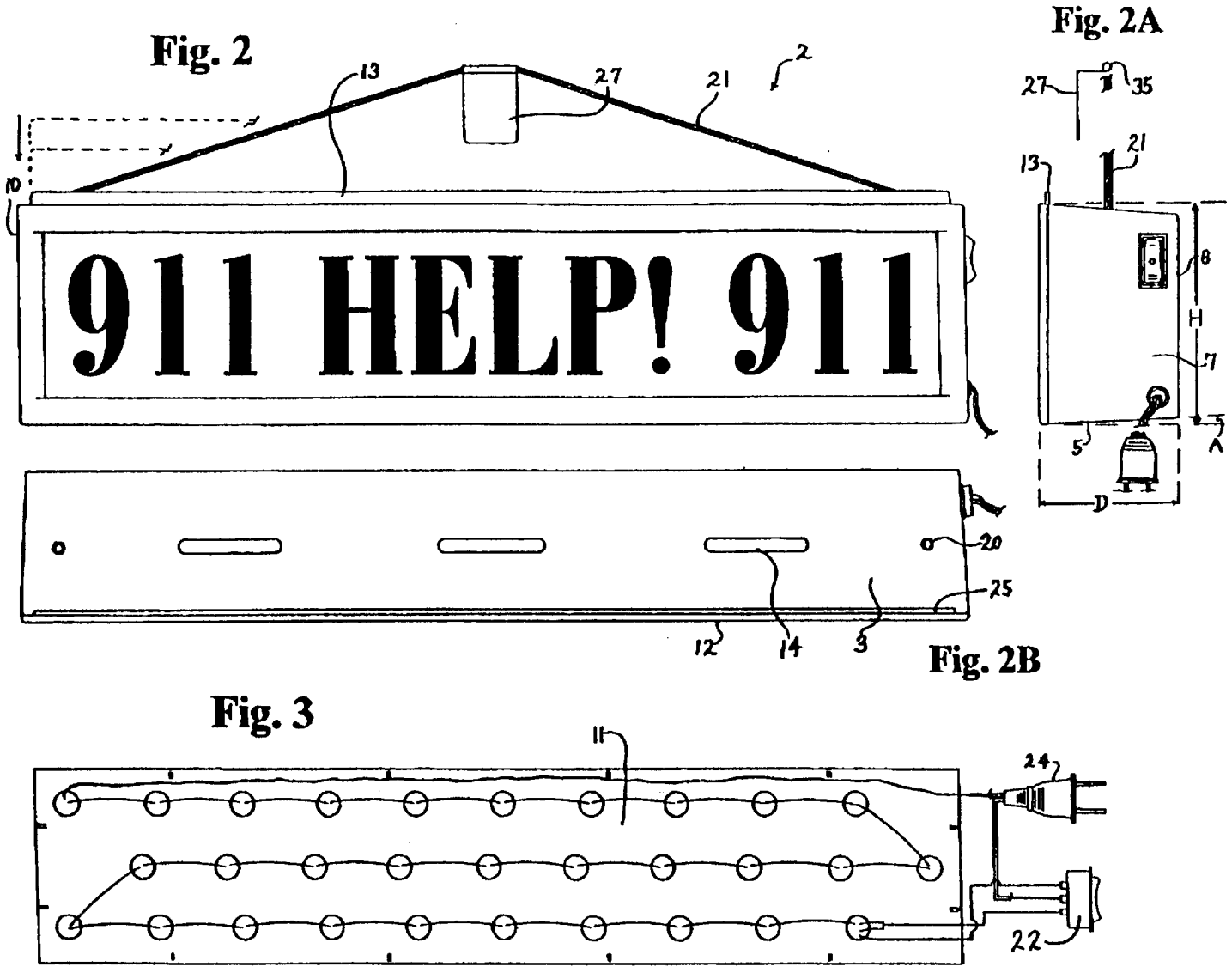
FIG. 2 Illustrates the front view of the locator sign with the "911 Help! 911" sign panel in place in the sign panel slot, and arrangement of the adjustable hanging cord and sash clip.
FIG. 2A illustrates a side end view of the locator sign of FIG. 2.
FIG. 2B illustrates a top view of the locator sign of FIG. 2.
FIG. 3 Illustrates the back of the lighting assembly panel with the wiring arrangement and diagram.

FIG. 1 Provides an exploded perspective view and cross sections of the locator sign 2 of the present invention. While a number of materials could be used for construction, the preferred construction is of high temperature resistant impact resistant, opaque ABS (acrylonitrile butadiene styrene) polymer resin. The ABS may be any known injection grade ABS which is resistant to warping and discoloration to at least a temperature of about 180° F to about 220° F. A typical ABS resin has CAS No. 9003-56-9. The locator sign 2 has a length "L" of about 16 to 24, typically 18, inches, a height "H" of about 3 to 6, typically 4, inches, and a depth "D" of about 2 to 4, typically 2.75, inches. As shown in FIG. 2, the locator sign 2 has a light box 10. The light box 10 includes a box of injection molded polymer and has a top wall 3, a bottom wall 5, side walls 7 and a back wall 8. The light box 10 is tapered, i.e., angled by an angle, e.g., angle "A" of FIG. 2B, from front to back, down from the top, up from the bottom, and in from the ends, at about 1 to 10, typically 3 degrees to provide a low profile, stylish appearance. However the box 10 can also be made as a rectangular box having sides at right angles to each other. The back wall 8 of the light box 10 is closed. Ribs 15, 15A protrude from the back wall 8, side walls 7, top wall 3 and/or bottom wall 5 (FIG. 4).

Figure 4:
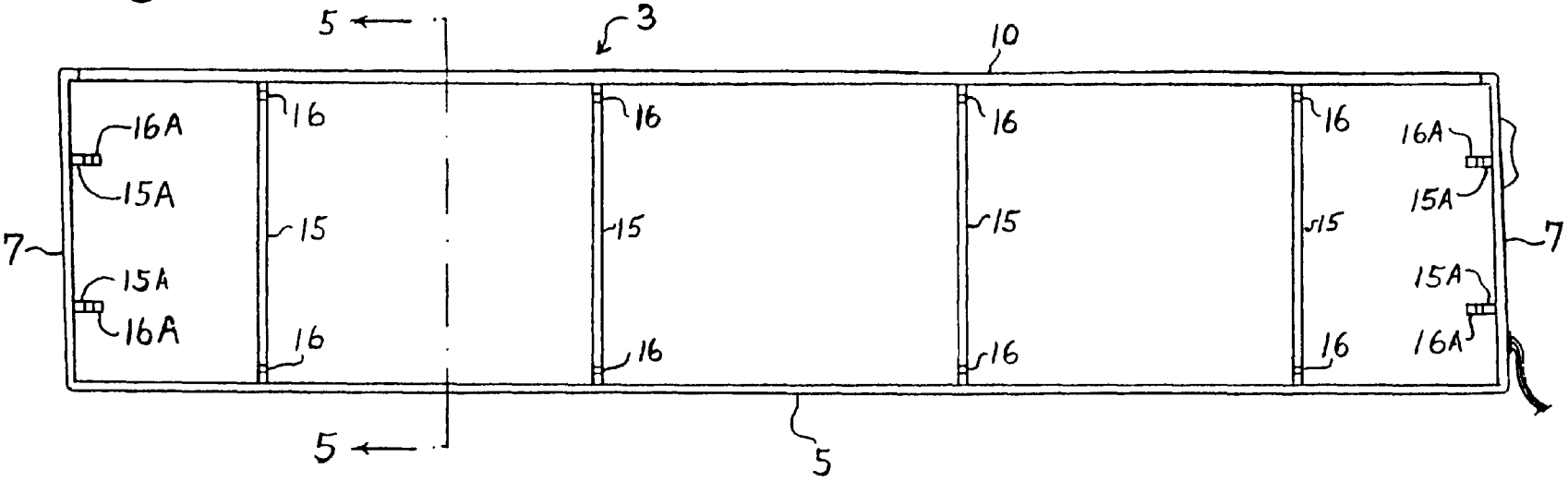
FIG. 4 illustrates a front view of the light box of FIG. 1 with some elements removed for clarity.
Figure 5:
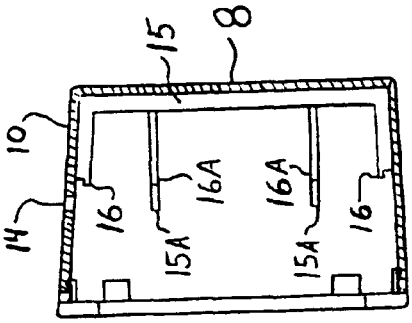
FIG. 5 is a cross-sectional view along line 5—5 of FIG. 4.
Figure 6:
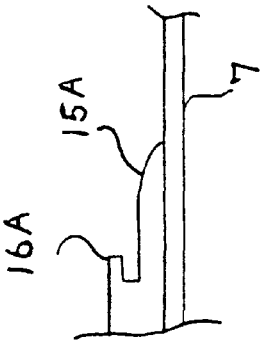
FIG. 6 is an enlarged view of a rib of FIG. 1.

As FIGS. 4–6 show, the light box 10 has four vertical ribs 15 which reinforce the back wall 8 and then turn and continue across the top wall 3 and bottom wall 5 to a point behind the slots 14 in the top wall 3. These slots 14 are on the center line of the top wall 3. The ribs 15 end about 40% from the back wall 8 in a tapered pin 16 which fits into a hole 17 (FIG. 1) of the light panel 11 and secures the light panel 11. Thus, a portion of each rib 15 is on each of top wall 3, back wall 8, and bottom wall 5. The side walls 7 each have two ribs 15A which end about 40% from the back wall 8 in a tapered pin 16A which fits into a hole 17A of lighting assembly panel 11 to secure panel 11.

Thus, the top wall 3 has four portions of ribs 15 with pins 16, the bottom wall 5 has four portions of ribs 15 with pins 16, the back wall 8 has four portions of ribs 15, and the side walls 7 each have two ribs 15A with pins 16A.

Located along the centerline of the top wall 3 of the light box 10, are three elongated light projection openings 14 evenly spaced along the top wall 3. These openings 14 are positioned just forward of a lighting assembly panel 11, and project radiant beams of light out of the top of the light box 10 to attract attention to the sign, and also allow excess heat from the lights to escape. Light is intended only to project from the top light projection openings and out through the front of a sign panel 13. Optionally, the bottom wall 5 of the light box 10 may also have three slots (not shown) along its center line.

As stated above, around the inside of the light box 10 are several ribs 15, 15A which end in tapered pins 16, 16A which interlock with the mounting holes 17, 17A of the lighting panel 11, and which hold and support the lighting panel 11 in place. Notches 18 molded into the end and bottom walls of the box near the forward edges receive and hold molded in hooks 19 from a front panel 12 and secure the front panel 12 in place. The hooks 19 also provide surfaces 26 to hold up the sign panel 13 to facilitate removal of the sign panel 13 by as few as two fingers of a person using the locator sign 2. Located on the inside bottom of the box 10, about ⅓ of the distance from each end (side wall 7), are guides 33 which direct the bottom of the sign panel 13 into place. The guides 33 begin at the back of the sign panel 13, and have a height of about ½ inch to ⅛ inch, typically about ¼ inch, and taper down therefrom toward the back of the box 10 where they blend into the bottom of the box 10 (see FIG. 1A).

On the top of the box at each end is a trimmed hole 20. These holes 20 typically have a 5/32 inch diameter to receive a ⅛ inch diameter adjustable hanging cord 21 which passes down through the top of the light box 10 and is knotted on the inside of the box 10 at the desired length.

An end (side wall 7) of the box 10 is fitted at the surface with a three position switch 22 for multi-modal operation of the lighting in the ON, OFF or BLINK position. As shown in FIG. 1, the same end fitted with the switch 22 also has, at the bottom, a strain relief 23 which secures a polarized 125 volt AC power supply cord 24.

Along the front edge of the top wall 3 of the light box 10 is a sign panel slot 25 which receives the sign panel 13. This slot 25 is formed between the front top edge of the box 10, and the top back edge of the front panel 12. In addition, the front panel 12 frames out the opening for the sign message or graphics. The molded in hooks 19 along the bottom of the front panel 12 provide surfaces 26 to raise the sign panel 13 up about ¼" from the outside bottom of the box 10 (see FIG. 1C).

The lighting assembly panel 11 is made of a molded plastic panel of high temperature resistant, high impact, ABS polymer plastic with ends 28 angled forward about 87 degrees or a matching angle to the side walls 7 of the light box 10. These angled end panels 28 extend forward to the back of the sign panel 13, and guide and hold the ends of the sign panel 13 in place. On the outside of each of the lighting end panels 28 are two spacers 29 which hold the end panels at a distance from the ends of the light box 10, thereby positioning the forward edges of the end panels to guide the sign panel 13 and hold it in place. Molded onto the lighting assembly panel 11 are light bulb retaining clips 30 (see FIGS. 1, 1B) which hold in place miniature light bulbs 31 including one blinker bulb 32. Thus, the light bulbs 31, 32, the three position switch 22, and the power cord 24 are wired together to provide three modes of lighting operation, ON, OFF, or BLINK. Typically, the power supply cord 24 is a standard polarized 125 volt AC power supply cord. Of course in locations which have a different standard AC voltage, miniature bulbs to accommodate such voltage would be employed. This configuration of lighting provides a low voltage, low heat, light source to light up the sign.

The miniature bulbs 31 and blinker bulb 32 are flexed in a horizontal position and spaced for an even light distribution which does not produce shadows or bright spots on the sign panel 13. Each bulb socket 34 is secured in place by two pair of specially designed clips 30 molded onto the light panel 11. The bulb socket 34 can easily be lifted from the clips 30 for removal and replacement of a burned out bulb. Each light is equipped with a shunt so that if one light burns out, the rest will stay on, maintaining the sign message.

FIG. 2–2B illustrate an arrangement of the adjustable hanging cord 21 and a sash clip 27, as well as the front, top and end views of the locator sign 2 with a sign panel 13 showing "911 Help! 911" in place in the sign panel slot 25. The sign panel 13 is made of translucent plastic material with translucent and opaque text and/or graphics printed onto the panel. Typically, sign panel 13 measures about 17⅜ inches long by 4 inches high, and 1/16 inches thick. Many different messages or graphics can be made for the sign panel 13. When the sign panel 13 is dropped through the sign panel slot 25, and is in place, the sign panel 13 preferably sits up on rest surfaces 26 (formed by the hooks 19, FIG. 1C) to be about ¼ inch above the bottom of the box 10. As a result, the sign panel 13 is easily lifted out of the box 10 with two fingers, for replacement with another sign panel 13 or to access the bulbs 31 for changing. The sign panels 13 can be changed easily and quickly for a delivery message or emergency message or display a holiday greeting sign panel (not shown). Moreover, the locator sign 2 can be used in combination with an ordinary household timer to automatically turn the locator sign 2 on and off.

The metal sash clip 27 is shown on the hanging cord 21 of FIG. 2. It is an "L" shaped piece of flat metal (FIG. 2A) which passes between the window sashes and suspends the invention in the window. The sash clip 27 is typically about 1¼ inch long, ⅝ inch on the horizontal, 1 inch wide, and 1/64 inch thick. Preferably the sash clip 27 is made of malleable steel.

The top of the sash clip 27 is rolled up and back to provide a typically 5/32 inch diameter hole 35 through which the hanging cord 21 passes from side to side.

FIG. 3 illustrates the back of the lighting assembly panel 11 with the wiring arrangement and diagram. Steady on A/C powered miniature bulbs 31 (FIG. 1) are arranged in series with the blinker bulb 32 wired at the end of the series through the three position switch 22, thereby allowing the operation of the lights in three modes. The bulbs 31 are low voltage electric bulbs. Typically, the overall length of a bulb 31 and its socket 34 is 1.5 inch. Typical such low voltage bulbs are miniature bulbs 31 which emit white light, use about 1.5 to 2 watts each to use about a 40 to about 60 watt power consumption, and operate on household current via a conventional power cord and polarized plug. Thus, the present invention avoids complexities of transformers, power packs, control circuits and transistors. Typical US household current is about 120 volt AC current. Of course, miniature bulbs for use in foreign countries can be employed to operate on a foreign country's local AC current.

To use the invention, the sash clip 27 is slid between window sashes (not shown), the sign panel 13 of choice is dropped into place, the unit 2 is plugged into an outlet, and switched to the desired mode of ON, OFF or BLINK.

While a detailed description of the invention is provided, it is to be understood that the scope of the invention is not to be limited thereby, but is to be determined by the scope of the claims which follow.

What is claimed is:

1. A light fixture for displaying a message comprising:

a light box made of opaque polymer plastic and having sidewalls, and an open front wall, at least one of said sidewalls defining a sign slot, said open front wall defining an open front area;

at least one preprinted removable sign panel for removably inserting into said sign slot whereby said sign panel protrudes from said sign slot;

a lighting assembly panel located inside said light box, said light assembly panel comprising a polymer panel upon which is mounted a circuit comprising a plurality of miniature continuous lights, and, optionally, a miniature blinker light bulb, the lights being wired together and removably secured to the lighting assembly panel by respective pairs of clips to provide even light distribution, said clips extending from said lighting assembly panel, said circuit being directly connectable to a power source;

said sign panel being removably located between said front wall and said lighting assembly panel, said box having an absence of partitions between said lights; and said sign panel sized to cover the open front area.

2. The light fixture of claim 1, said circuit comprising a power cord and electrical plug in electrical communication with said plurality of lights for directly powering said lights by AC current from a conventional wall socket.

3. The light fixture of claim 2, wherein the power cord is connected to said plurality of lights for directly powering said lights by 125 volt AC current.

4. The light fixture of claim 1, wherein said circuit comprises said blinking light bulb and further comprising a three position switch attached to said plurality of lights to operate the lights in the modes of on, off and blink, wherein said circuit has a lack of each member of the group consisting of transformers, power packs, controllers, capacitors and transistors.

5. The light fixture of claim 1, wherein said circuit consists of a power cord of two or three parallel wires and a polarized plug, said plurality of continuous lights, said blinker bulb, wires connecting said continuous lights in series, and a three way switch attached to said plurality of lights to operate the lights in the modes of on, off and blink, wherein said blinker bulb is connected in series to said continuous lights through said switch, said switch bypassing said blinker bulb in said on mode.

6. The light fixture of claim 1, wherein one of said sidewalls is a top wall, said sign slot being defined at least partly by said top wall, said sign panel sized to protrude from said top wall, when said sign panel is in an at rest position in said box.

7. The light fixture of claim 6, wherein said top wall has three elongated light projection slots.

8. The light fixture of claim 1, wherein said sidewalls and lighting assembly panel have opaque inner surfaces.

9. The light fixture of claim 1, having an absence of reflectors for backlighting the sign panel.

10. The light fixture of claim 1, wherein said circuit has a lack of each member of the group consisting of transformers, power packs, controllers, capacitors and transistors.

11. The light fixture of claim 1, wherein said circuit comprises a single power supply cord with a conventional household polarized plug for supplying power to said circuit.

12. The light fixture of claim 1, wherein one of said sidewalls is a top wall and said top wall defines said sign slot and defining at least one light projection slot between said sign slot and the back of the light box, wherein a user can change messages or graphics quickly and easily, without the use of any tool or utensil, from one said preprinted sign panel to another said preprinted sign panel for displaying different respective messages, each said sign panel comprising a translucent panel with translucent or opaque text or graphics on said respective panel, wherein the only light discharge from said fixture is through said sign panel and said light projection slots, whereby said light projection slots project light to attract attention to said light fixture, said sign panel sized to protrude from said top wall, when said sign panel is in an at rest position in said box.

13. The light fixture of claim 1, further comprising a hanging cord and a sash clip;

wherein one of said side walls is a top wall having holes for attaching said hanging cord to said light box; and wherein said hanging cord is movably secured to said sash clip.

14. The light fixture of claim 1, wherein at least one said side wall forms an inwardly tapering angle with said front wall of about 89° to about 80°.

15. The light fixture of claim 1, having a length of about 16 to about 24 inches, a height of about 3 to about 6 inches and a depth of about 2 to about 4 inches.

16. A light fixture for displaying a message comprising:

a light box made of opaque polymer plastic and having sidewalls, and an open front wall, at least one of said sidewalls defining a sign slot, said open front wall defining an open front area;

at least one preprinted removable sign panel for removably inserting into said sign slot whereby said sign panel protrudes from said sign slot;

a lighting assembly panel comprising a polymer panel upon which is mounted a circuit comprising a plurality of miniature continuous lights, and, optionally, a miniature blinker light, the lights being wired together and removably secured to the lighting assembly panel by respective pairs of clips to provide even light distribution, said clips extending from said lighting assembly panel, said circuit being directly connectable to a power source;

said sign panel being removably located between said front wall and said lighting assembly panel, said box having an absence of partitions between saids lights; and said sign panel sized to cover the open front area, wherein one of said side walls is a top wall, and another of said side walls is a bottom wall, said top wall and bottom wall being opposed, further comprising a back wall and ribs extending from said bottom wall to contact said back wall of the lighting assembly panel.

17. The light fixture of claim 16, wherein clips extend from said light box front wall for interlocking with said light box bottom wall and providing a surface for supporting said sign panel.

18. The light fixture of claim 17, wherein said ribs extend along said back wall and from said back wall along said top wall and bottom wall and have tapered pin ends which interlock with mounting holes of the lighting assembly panel.

19. The light fixture of claim 17, wherein said light box further comprises ribs which extend along said side walls, respectively, and have tapered pin ends which interlock with mounting holes of the lighting assembly panel.

20. The light fixture of claim 17, wherein the lighting assembly panel is U-shaped and has a lighting assembly back wall, upon which said lights are mounted, and lighting assembly side walls extending from said lighting assembly back wall, and spacers extending from said lighting assembly side walls for separating said lighting assembly side walls from said light box side walls.

21. A light fixture for displaying a message comprising:

a light box made of opaque polymer plastic and having sidewalls, and an open front wall, at least one of said sidewalls defining a sign slot, said open front wall defining an open front area;

at least one preprinted removable sign panel for removably inserting into said sign slot whereby said sigh panel protrudes from said sign slot;

a lighting assembly panel comprising a polymer panel upon which is mounted a circuit comprising a plurality of miniature continuous lights, and, optionally, a miniature blinker light, the lights being wired together and removably secured to the lighting assembly panel by respective pairs of clips to provide even light distribution, said clips extending from said lighting assembly panel, said circuit being directly connectable to a power source;

said sign panel being removably located between said front wall and said lighting assembly panel, said box having an absence of partitions between said lights; and said sign panel sized to cover the open front area, wherein said light box further comprises ribs which extend along said side walls, respectively, and have tapered pin ends which interlock with mounting holes of the lighting assembly panel.

* * * * *